United States Patent [19]

Showalter

[11] Patent Number: 4,609,342

[45] Date of Patent: Sep. 2, 1986

[54] ABATEMENT OF $NO_x$ FROM HETEROGENEOUS COMBUSTION SOURCES BY ULTRAHOMOGENEOUS AIR-EGR MIXING

[75] Inventor: Merle R. Showalter, Madison, Wis.

[73] Assignee: Automotive Engine Associates, Madison, Wis.

[21] Appl. No.: 799,549

[22] Filed: Nov. 18, 1985

Related U.S. Application Data

[63] Continuation of Ser. No. 457,019, Jan. 10, 1983, abandoned.

[51] Int. Cl.[4] ..... F23B 7/00

[52] U.S. Cl. ..... 431/2; 431/115; 431/354; 123/568; 48/180 R; 60/274; 110/345

[58] Field of Search ..... 431/2, 5, 115, 354, 431/8, 9; 123/568; 110/204, 345; 48/180.1, 189.5; 60/272–274, 278, 750, 317

[56] References Cited

U.S. PATENT DOCUMENTS

| | | | |
|---|---|---|---|
| 3,799,130 | 3/1974 | Dahlstrom | 123/568 |
| 3,890,945 | 6/1975 | Goto et al. | 123/568 |
| 4,014,639 | 3/1977 | Froehlich | 431/115 X |
| 4,027,635 | 6/1977 | Goto et al. | 123/568 |
| 4,030,874 | 6/1977 | Vollerin | 431/115 X |
| 4,112,892 | 9/1978 | Lindberg | 123/568 |
| 4,135,874 | 1/1979 | Tsuzi et al. | 431/115 |
| 4,335,660 | 6/1982 | Maloney et al. | 110/345 X |

FOREIGN PATENT DOCUMENTS

| | | | |
|---|---|---|---|
| 0152231 | 11/1979 | Japan | 431/115 |
| 80/00731 | 4/1980 | PCT Int'l Appl. | 48/189.5 |

*Primary Examiner*—Margaret A. Focarino

*Attorney, Agent, or Firm*—Witherspoon & Hargest

[57] ABSTRACT

$NO_x$ abatement results with EGR obtained in practice have been drastically less than those predicted by kinetic calculations. This disparity can be eliminated in all heterogeneous combustion processes by complete mixing to the microscale of exhaust gas recirculation with intake air prior to introduction into the heterogeneous burner. To achieve the required mixedness the air and EGR must be folded together in a controlled fashion in a turbulent flow having mean flow streamlines structured so that turbulent diffusion and molecular diffusion need only act to mix at relatively small distances. Scaleable vortex mixing means to achieve this folding together and mixing are disclosed. Complete vortex mixing of air and EGR prior to the supply of this "oxidizer mix" into heterogeneous combustion systems such as diesel engines, stationary turbines, large burners, and power plants produces radical $NO_x$ reductions at low cost.

10 Claims, 19 Drawing Figures

Figure 1:
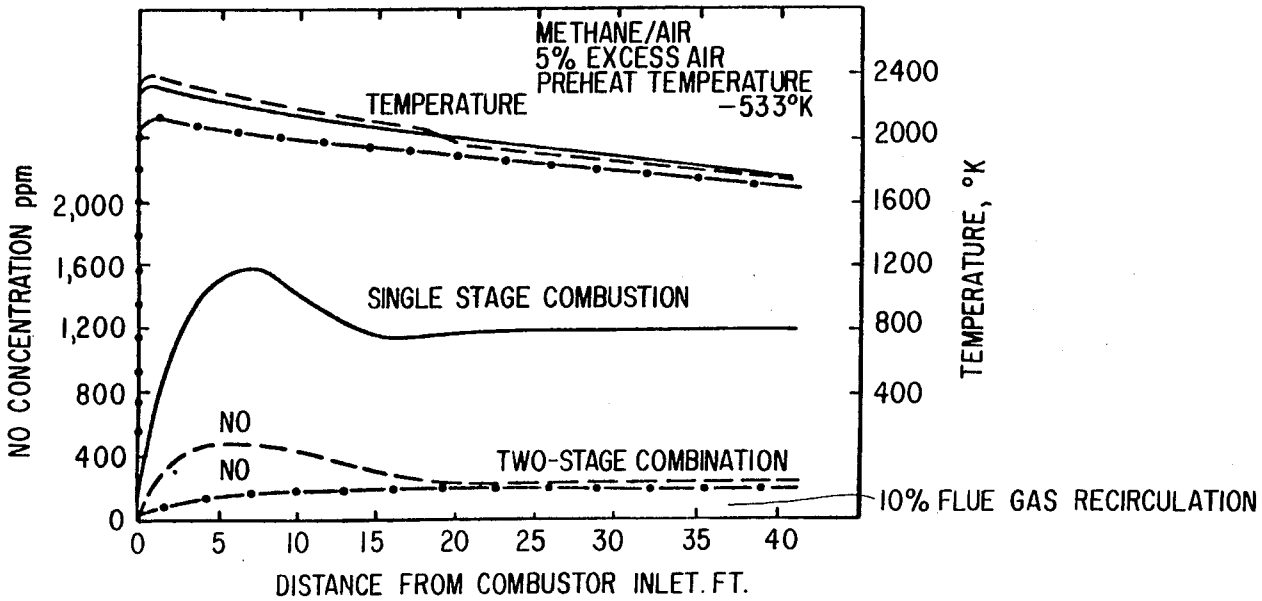

SOURCE: "NITRIC OXIDE EMISSIONS FROM STRATIFIED CHARGE ENGINES: PREDICTION AND CONTROL" BY P.N. BLUMBERG, FORD MOTOR COMPANY

IRROTATIONAL VORTEX FLOW TO CENTRAL SINK:

$V_{TANGENTIAL}(r) = \frac{V_{tr_o} r_o}{r}$ $V_{RADIAL}(r) = \frac{V_{rr_o} r_o}{r}$

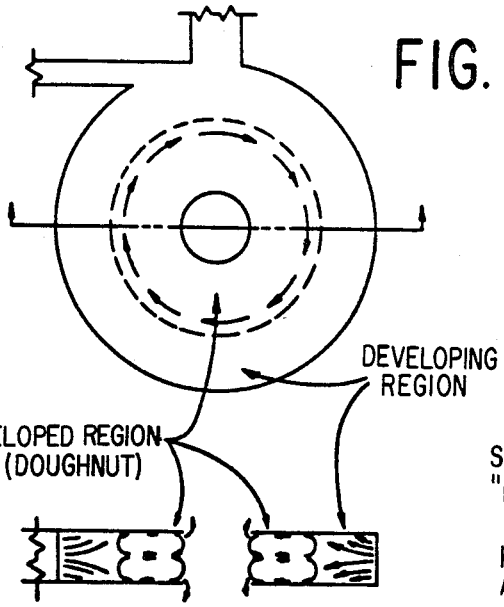
FIG. 10
FIG. 11
SOURCE FOR FIGURES 10 & 11 "DESIGN THEORY OF FLUIDIC COMPONENTS" BY JOSEPH M. KIRSHNER AND SILAS KATZ ACADEMIC PRESS, INC.
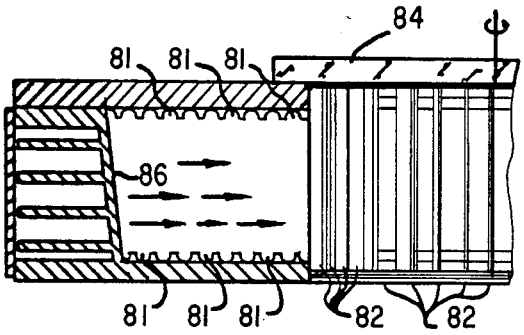
FIG. 12
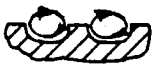
FIG. 12a

SECTION F-F & G-G

ABATEMENT OF $NO_x$ FROM HETEROGENEOUS COMBUSTION SOURCES BY ULTRAHOMOGENEOUS AIR-EGR MIXING

This application is a continuation of application Ser. No. 457,019, filed Jan. 10, 1983, now abandoned.

BACKGROUND AND OBJECTS $NO_2$ is an important air pollutant. $NO_2$ is toxic itself and enters into the complex of chemical reactions which produce photochemical smog. Nitrogen oxides also combine with water to form nitric acid, and contribute significantly to the national problem of "acid rain." $NO_x$ is formed at elevated temperature by endothermic chemical reactions which combine nitrogen with oxygen. Equilibrium concentrations of NO, which forms before $NO_2$, increase rapidly with temperature, and the kinetics of NO formation is an extremely sensitive increasing function of temperature. The basic kinetics of $NO_x$ formation is fundamentally the same for all combustion processes, wheether they occur in reciprocating piston engines, turbine combustors, or large burners of one or another kind. In every case, the supression of peak flame temperature can radically reduce $NO_x$ outputs in the combustion products.

Total $NO_x$ outputs in the United States were estimated to be as follows in 1975 (Source: *Air Pollution,* by Henry C. Perkins, McGraw-Hill Book Company, 1974, page 292):

Mobile Sources: 39 percent
Electric Utilities: 23 percent
Pipelines and Gas Plants: 13 percent
Industrial Burners: 19 percent
Household and Commercial: 6 percent On a world-wide basis human $NO_x$ generation is even more dominated by large burners and other non-automotive sources, with coal combustion constituting 50 percent of world-wide $NO_x$ generation, petroleum refining and other oil burning constituting 28 percent of $NO_x$ emissions, and gasoline combustion only accounting for 14 percent of total world-wide $NO_x$. (Source: Perkins op. cit., page 293.)

$NO_x$ from gasoline automobiles, which are the dominant mobile $NO_x$ source, can be greatly reduced. For example, the engine design of Automotive Engine Associates described in U.S. Pat. No. 4,344,394, "High Swirl Very Low Pollution Piston Engine Employing Optimizable Vorticity", permits $NO_x$ emissions from gasoline automobiles to be reduced by more than a factor of ten. $NO_x$ emissions from other sources have not been reduced by anything like the same proportion, so in the future it is likely that the $NO_x$ emissions represented by electric utilities, pipelines and gas plants, and industrial burners will become an increasing percentage of total $NO_x$ emissions. In recognition of this, control agencies are tightening $NO_x$ control requirements for these non-automotive sources. The control technology which presently exists for $NO_x$ control from power plants and the other large $NO_x$ sources is expensive and unsatisfactory. It is the purpose of the present invention to produce an inexpensive and very effective means of controlling $NO_x$ from these large sources.

The NO formation process in flames and post-flame gases depends intimately on the temperature-pressure-time history of the individual product of combustion elements. Total NO output from a burner is the integrated NO output from the individual elements. In heterogeneous combustion systems, concentration of NO may vary from element to element within a burner as much as a factor of 1,000 because NO kinetics is such a strong function of chemical species concentrations. Although the kinetics of NO formation is conceptually clear, the computational difficulties of analyzing NO formation in heterogeneous combustion systems are great. Conceptually, it is much easier to think about NO formation in homogeneous combustion systems.

A good description of the kinetics of the $NO_x$ formation process in flames is described in Perkins, op. cit., pages 302–308. The kinetics there described is well-established in the scientific sense, and it is clear that rates of NO formation and equilibrium $NO_x$ concentrations increase very rapidly as temperature increases. Table 12.9 from page 306 of Perkins shows this relation, and is reproduced below.

TABLE 12.9

Time for NO formation in a gas containing 75 percent nitrogen and 3 percent oxygen

| Temperature, °F. | Time to form 500 ppm NO, sec | NO concentrations at equilibrium, ppm |
|---|---|---|
| 2400 | 1,370 | 550 |
| 2800 | 16.2 | 1,380 |
| 3200 | 1.10 | 2,600 |
| 3600 | 0.117 | 4,150 |

Source: AP-67.

Time to form 500 parts per million NO is very temperature sensitive. Reducing temperature from 3600° F. to 2800° F. cuts the rate of NO formation 138-fold. A 400° F. drop from 3600° F. to 3200° F. cuts rates by a factor of 9.4. A 400° F. drop from 3200° F. to 2800° F. cuts rates 14.7-fold. A further 400° F. drop from 2800° F. cuts rates by a factor of 84.6. For different oxygen percentages (different air/fuel ratios) the trends of NO formation with temperature are similar. Formation rates also go as the square of species concentrations, and chemical equilibria vary with concentration (pressure) in a way which should be familiar to those who have studied chemical kinetics.

As the fuel/air ratio of a combustible element changes, the $NO_x$ formed from its combustion products will change because changing air/fuel ratio varies peak flame temperature (since it varies the energy of the fuel available to raise the temperature of the fuel and air atoms' mass) and because changing air/fuel ratio changes oxygen available to combine with nitrogen. As will be made clear in the drawings, the temperature effect is typically more important than the oxygen availability effect. So long as an element of combustible mixture is *locally* homogeneous, its $NO_x$ formation behavior will be straightforwardly described by chemical kinetics calculations. If a mixture of fuel and air is heterogeneous, with many elements at many different air/fuel ratios, the conceptual process of $NO_x$ formation is the same but the arithmetic difficulties of integrating $NO_x$ effects which differ from element to element are formidable.

Complete mixing to molecular scales of fluids is quite difficult, and the difficulty of mixing becomes greater as the geometric scale of the mixer or burner increases. For this reason, the industrial designs which produce combustion on a large scale are heterogeneous. Combustion in electrical power plants is heterogeneous when natural gas is burned, yet more heterogeneous for oil-fired plants, and more heterogeneous still for coal-burning plants. The same can be said for large industrial burners.

Both power plants and large industrial burners are applications where fuel economy is important, and the need to minimize stack heat losses [stack loss equals M $C_P(T-T_{ambient})$] constrains the overall operation of the burners to air/fuel ratios having just enough excess air to complete combustion under the mixing conditions in the burner. Minimum excess air is required to minimize massflow, M, up the stack. $NO_x$ control from these large burners cannot, therefore, involve variations in air/fuel ratio without significant fuel penalties.

The other large sources of $NO_x$ also do not permit variation of air/fuel ratio for $NO_x$ control. Nitric oxide generated in pipelines is generated in the heterogeneous can combustors of stationary turbine engines or in the heterogeneous combustion processes happening in the very large and badly mixed natural gas reciprocating engines used to drive pumps. For both the turbine and reciprocating pump engines, load control is largely achieved by variations in air/fuel ratio. These systems are both so heterogeneous in their mixing processes that they would have many zones producing NO at a maximum rate regardless of the overall air/fuel ratio of operation which might be chosen.

Diesel engines, some of which are mobile and some of which are stationary, also achieve load control by variation in fuel input, and are also inescapably heterogeneous because fuel is sprayed into combustion air only a few milliseconds before combustion initiates, making homogeneity at the level relevant to chemical kinetics impossible.

The inventor has spent the last decade working to control mixing and chemical concentrations to radically reduce NO formation in the flames which occur in spark-fired, internal combustion engines. The work done by the inventor, (largely described in U.S. Pat. No. 4,344,934), shows that complete microscale and large-scale homogeneity of fuel, air and residual gas produces radical (as much as 1,000-fold) reductions in $NO_x$. These $NO_x$ reductions fit closely the theoretical predictions of chemical kinetics. It should be emphasized that the physical scale on which combustion and the NO forming chemical reactions occur is of the order of molecular mean free paths or at most localities in the size range of a few cubic microns. The chemistry occuring in these tiny volumes should not vary with the container in which these tiny volumes occur. There is every reason to believe that the chemical kinetics of NO formation is as valid in a hundred megawatt power plant as in a small reciprocating piston engine. If the mixing state of the individual elements which burn can be well-described, kinetics should predict accurately NO formation rates.

$NO_x$ formation from non-mobile sources is dominated by heterogeneous combustion process. Fuel/air ratio varies radically from place to place within the burner, and temperature-pressure-time trajectories which determine NO formation vary accordingly. However, it is still possible to radically control NO formation in these heterogeneous combustion processes.

The approach is simply stated. If some of the products of combustion, after doing work on turbines or passing through heat exchanger tubes, are recirculated into the intake air and *perfectly mixed* with this air prior to introduction of the EGR-air mixture to the burner, peak flame temperatures in the burner will be lowered for *every* element of fuel/air mixture burned because every element of fuel/air mixture will have the same ratio of diluent to air, and this EGR diluent, because of its specific heat and mass, will suppress peak flame temperatures. This lowering of peak combustion temperatures will occur in every element to be burned regardless of the details of the fuel-oxidizer mixing process in the burner. Because NO formation rates are temperature sensitive, this lowering of combustion temperatures will reduce NO output. The magnitude of the NO reduction can be very large.

It should be noted that exhaust gas recirculation percentage does not change the stack losses and efficiency of a powerplant or large burner so long as stack gas temperature does not change, since EGR does not change mass flow out the stack, M. EGR is also compatible with the operation of large reciprocating piston natural gas engines, turbine combustors, and diesels. From a combustion point of view, the better mixed the EGR is with the rest of the air, the more EGR can be tolerated.

The idea of exhaust gas recirculation for $NO_x$ control is not new. EGR equipment has been installed in power plants, stationary burners, stationary turbines and large reciprocating natural gas engines pumping for natural gas pipelines, and diesel engines for many years. However, the $NO_x$ suppression results achieved with these devices have been radically less than those which could have been achieved with the same exhaust recycle percentages if the EGR was homogeneously mixed with the rest of the air.

The theoretical advantages of EGR have been long known. In the figures, kinetics calculation results from Bartok (Exxon Research) are shown indicating a 90 percent $NO_x$ reduction, with 10 percent exhaust gas recirculation, for a homogeneous combustor case. The same sort of calculation would indicate a 98 percent reduction for 20 percent exhaust recirculation. However, 20 percent exhaust gas recirculation, mixed conventionally, has been used in many power plant burners. In these burners, the EGR only cuts $NO_x$ output in half.

The disparity between $NO_x$ reductions available in theory and those obtained in large scale burners is due to bad EGR-air mixing. However, efforts to control $NO_x$ with EGR have taken low priority in industry, and extremely expensive schemes for catalytic reduction of $NO_x$, some of them involving capital expenditures of billions of dollars, are being actively pursued. This is happening because the vital important of EGR-air mixing to the $NO_x$ reductions obtained has not been understood.

In addition, mixing fluid mechanics is a difficult business, and mixing sections capable of producing the required large-scale, middle-scale and micro-scale homogeneity of air and EGR have not been available. The efforts of the inventor to produce practical and rapid mixing using controlled flow structures make it possible now to build such mixing sections practically. The basic structured turbulent flow mixing process has been worked out and tested on reciprocating spark-fired engines, but can be scaled-up readily to the sizes required for large stationary burners.

It is important to realize how difficult complete mixing is, and how unsatisfactory conventional mixing techniques are in industry. Moreover, it is important to realize that the current state of engineering and fluid mechanical knowledge concerning the detailed processes required to achieve complete mixing is in a primitive state. Insights into the structure of turbulence and recognition of the importance of the problme now make mixing an important and accessable research problem in fluid mechanics. For instance, a team of researchers including professors S. J. Kline, B. J. Cantwell, and L. Heselink at Stanford University are now (1983) initiating a major effort to study mixing in jets and in structured flow sections such as the one worked out by the inventor.

SUMMARY

It is the purpose of the present invention to teach how homogeneous mixing of EGR with air can practically suppress $NO_x$, and to described a structured turbulent flow vortex mixing process which achieves the required homogenization of air and EGR. The air-EGR mixing technique can readily be applied to existing burners to radically suppress $NO_x$ formation at a relatively low cost. The mixing flow patterns are high Reynolds numbers flow patterns which scale readily up to very large sizes. $NO_x$ control via homogeneous air-EGR mixing is applicable to diesel engine combustion, the combustion of large natural gas reciprocating engines, the combustion in the cans of stationary turbines, and the combustion process in natural gas, oil, or coal burners of large scale.

IN THE DRAWINGS

FIG. 1 shows typical NO-temperature profiles predicted by a mathematical model showing the effects of two-stage combustion and flue gas recirculation on a homogeneous burner (Source: Bartok et. al. Exxon Research and Engineering Company, page 312 of *Air Pollution,* Henry C. Perkins, McGraw-Hill Book Company, 1974). The figure shows that the model predicted approximately a ten-fold reduction in nitric oxide output with the moderate EGR percentage of ten percent, on the assumption that fuel, air and EGR were homogeneously mixed prior to combustion.

Figure 2:
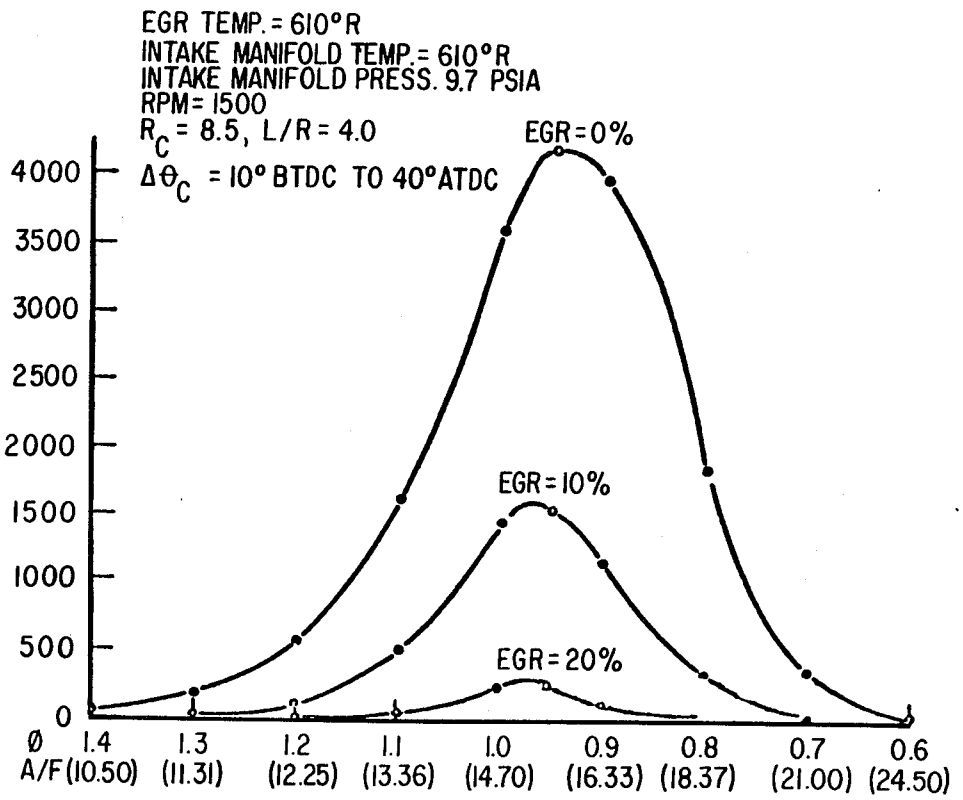

FIG. 2 illustrates the effect of fuel/air equivalence ratio on $NO_x$ output for three levels of exhaust gas recirculation for an internal combustion engine. (Source: "Nitric Oxide Emissions from Stratified Charge Engines: Prediction and Control" by Paul N. Blumberg, Ford Motor Company, which was released to a Combustion Institute meetng in Urbana, Ill. in March 1973.) The figure is for a homogeneous charge spark-fired engine, but shows the general result that the $NO_x$ vs. air/fuel ratio curve shifts downward rapidly with increasing EGR. For a burner at atmospheric pressure, the $NO_x$ curve for homogeneous combustion roughly corresponds to the twenty percent EGR curve of FIG. 2.

Figure 3:
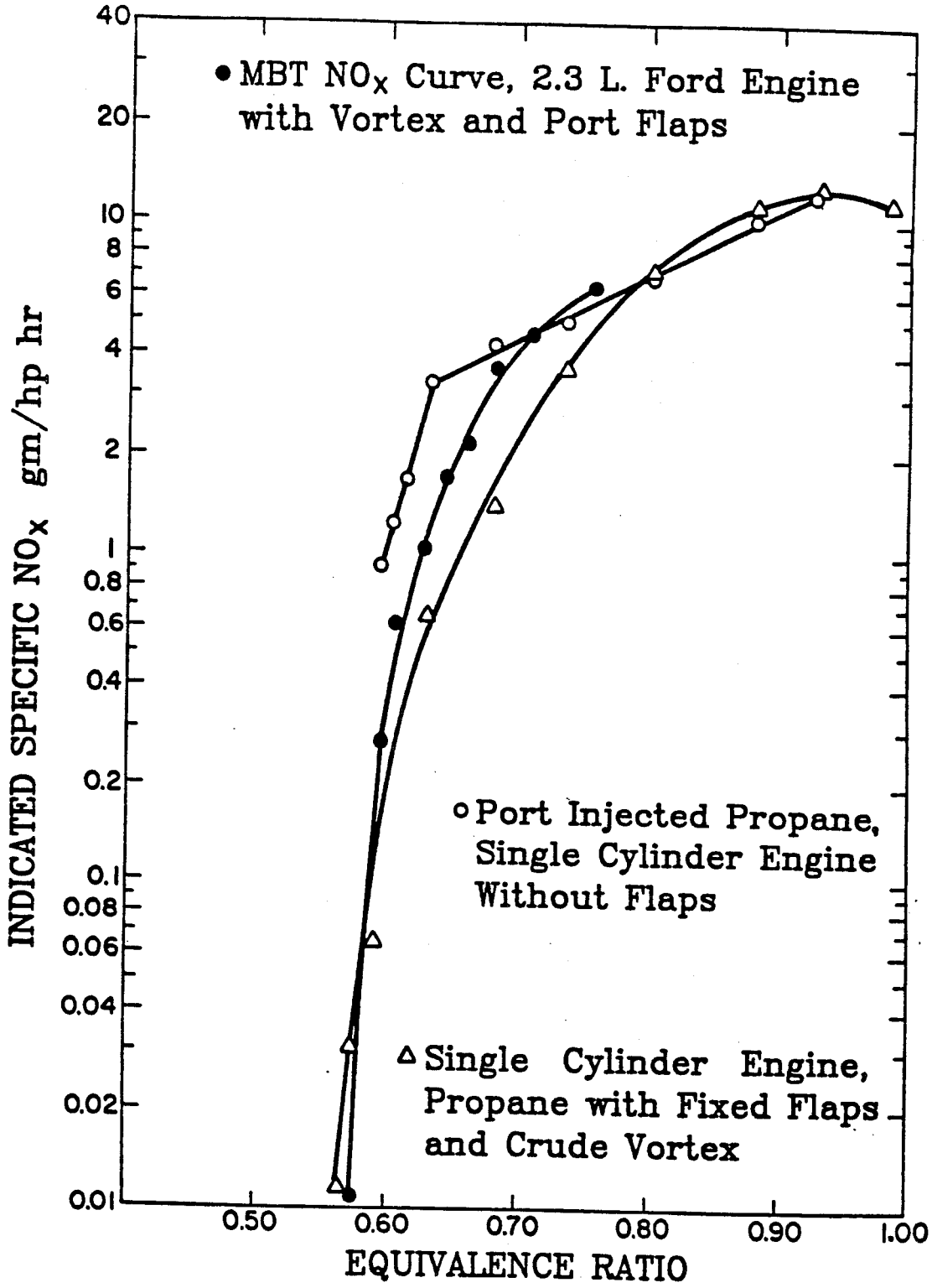

FIG. 3 illustrates the radical reductions in $NO_x$ output possible with complete homogeneous combustion in a spark-fired engine built according to "High Swirl Very Low Piston Engine Employing Optimizable Vorticity," U.S. Pat. No. 4,344,394. The 1000:1 range on $NO_x$ output illustrates the extreme sensitivity of $NO_x$ output to equivalence ratio. The data illustrated are strongly consistent with the conventional kinetics mathematical models of $NO_x$ formation, which also apply to other combustion systems.

Figure 4:
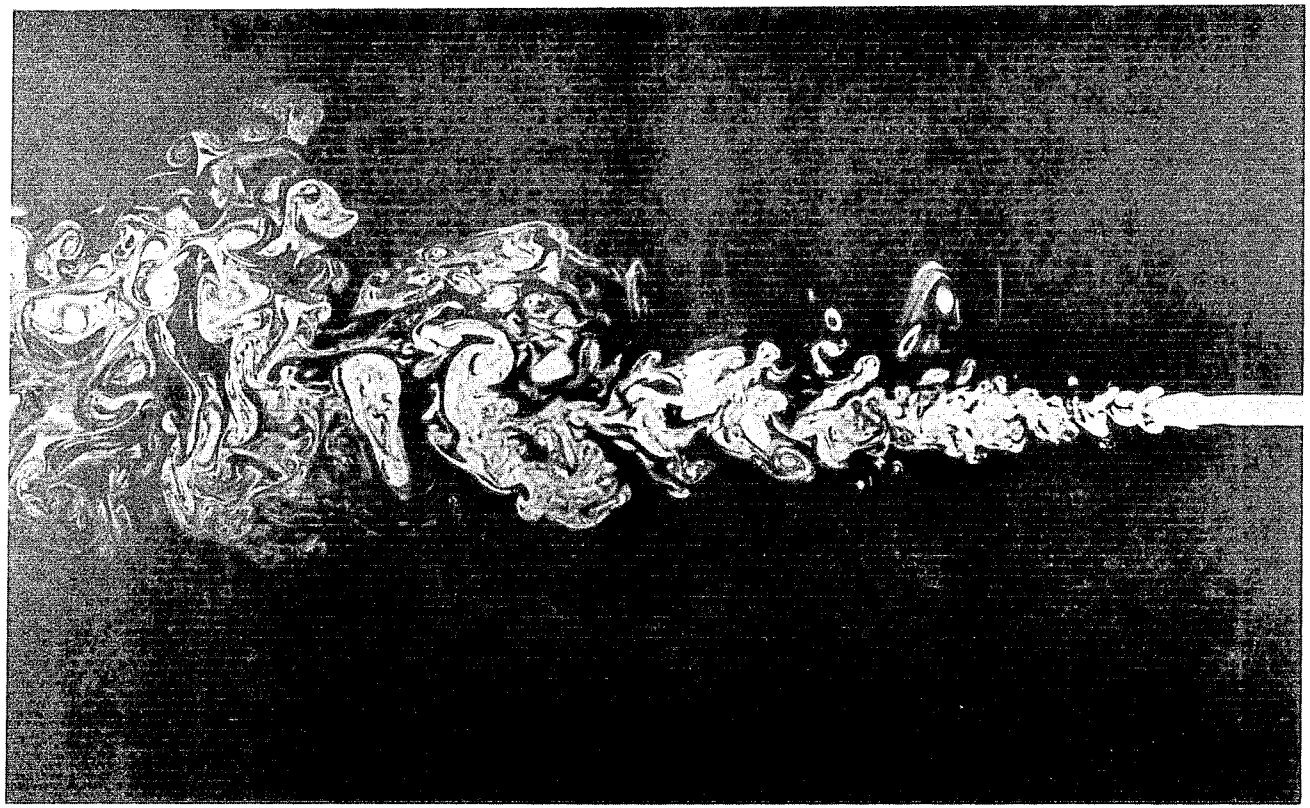

FIG. 4 shows the extreme lumpiness of conventional jet mixing in a photograph where a laser-induced florescence illuminates a planar cut across a turbulent mixing jet. (Source: Dimotakis, Lye and Papantoniou 1981 reproduced from page 97 of *An Album of Fluid Motion,* assembled by Milton Van Dyke, Parabolic Press, Stanford, Calif. 1982.) The lumpiness of mixing illustrated in the photograph is characteristic of the jet mixing process which is the basic mixing process in virtually all current combustors and all present commercial turbulent mixing sections. It has been commonly believed that flow through a mixing jet such as that illustrated by Dimotakis et al produces homogeniety down to microscales. This is clearly not true, and a more organized mixing process is required to produce large-scale, middle-scale and micro-scale homogeniety of EGR and air.

Figure 5:
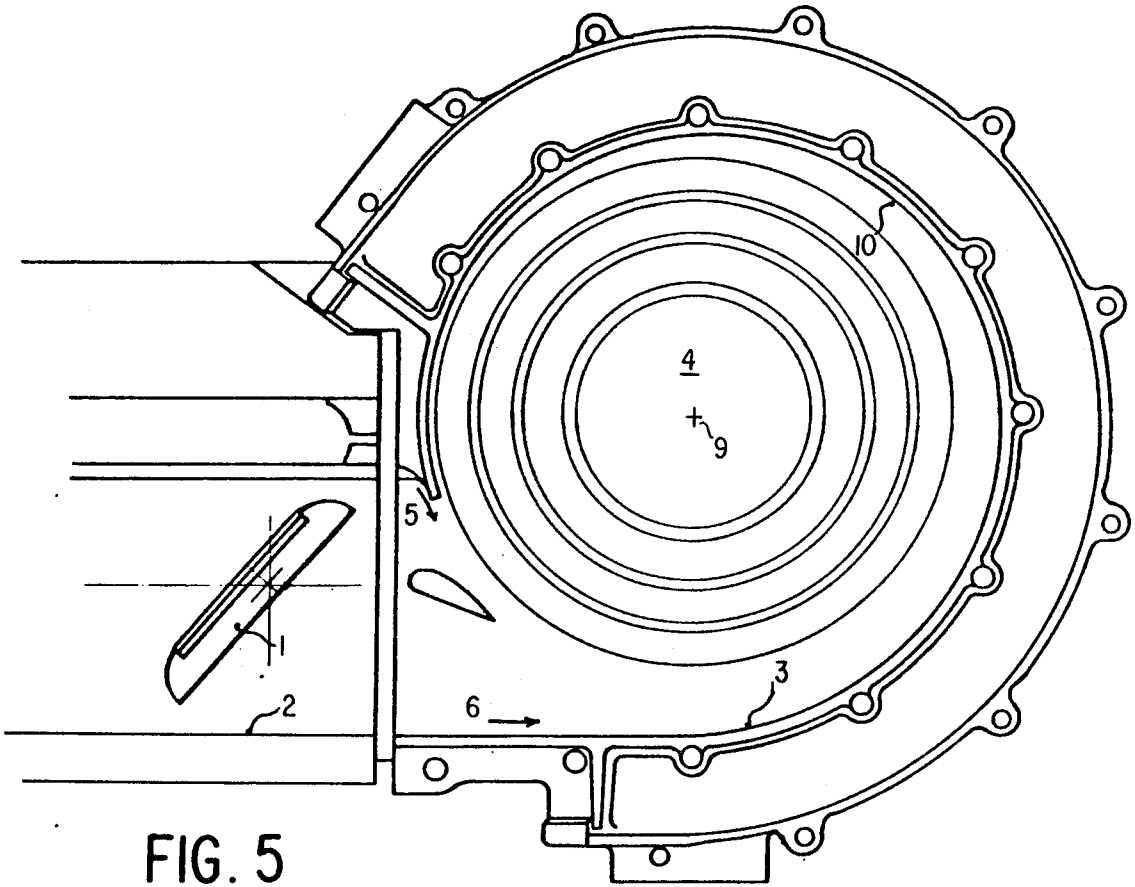

FIG. 5 shows a sketch of a mixing section of the inventor's covered by U.S. Pat. No. 4,318,386 showing a mixing section which produces an irrotational vortex mean flow pattern which is not characterized by the lumpiness illustrated in FIG. 4 and which produces an organized folding together of mixants with random diffusion occuring only on relatively fine scales, to produce mixing rates much faster than those previously thought possible. The vortex mixer illustrated has been successfully used in an internal combustion engine and was on the engine which produced the $NO_x$ curve of FIG. 3 with the radical $NO_x$ reduction illustrated in that figure.

FIGS. 6, 7, 8, 9, 10, 11, 12 and 12*a* illustrate the vortex flow pattern useful for mixing and illustrates the fundamental argument of structured turbulent flow mixing. FIGS. 6–12*a* are also FIGS. 6–12*a* in U.S. Pat. No. 4,318,386 by the present inventor with K. W. Kriesel and C. L. Siewert.

Figure 13:
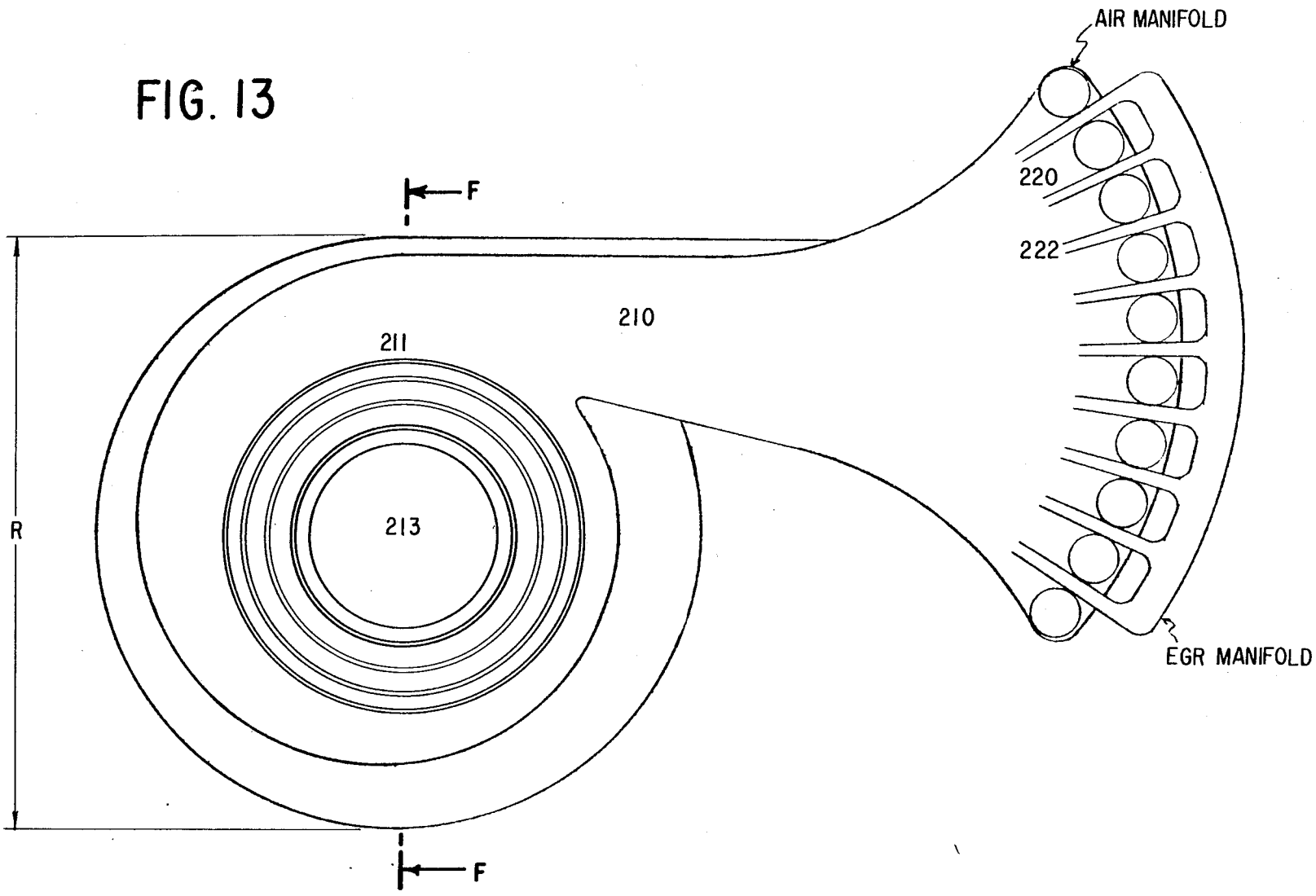
Figure 15:
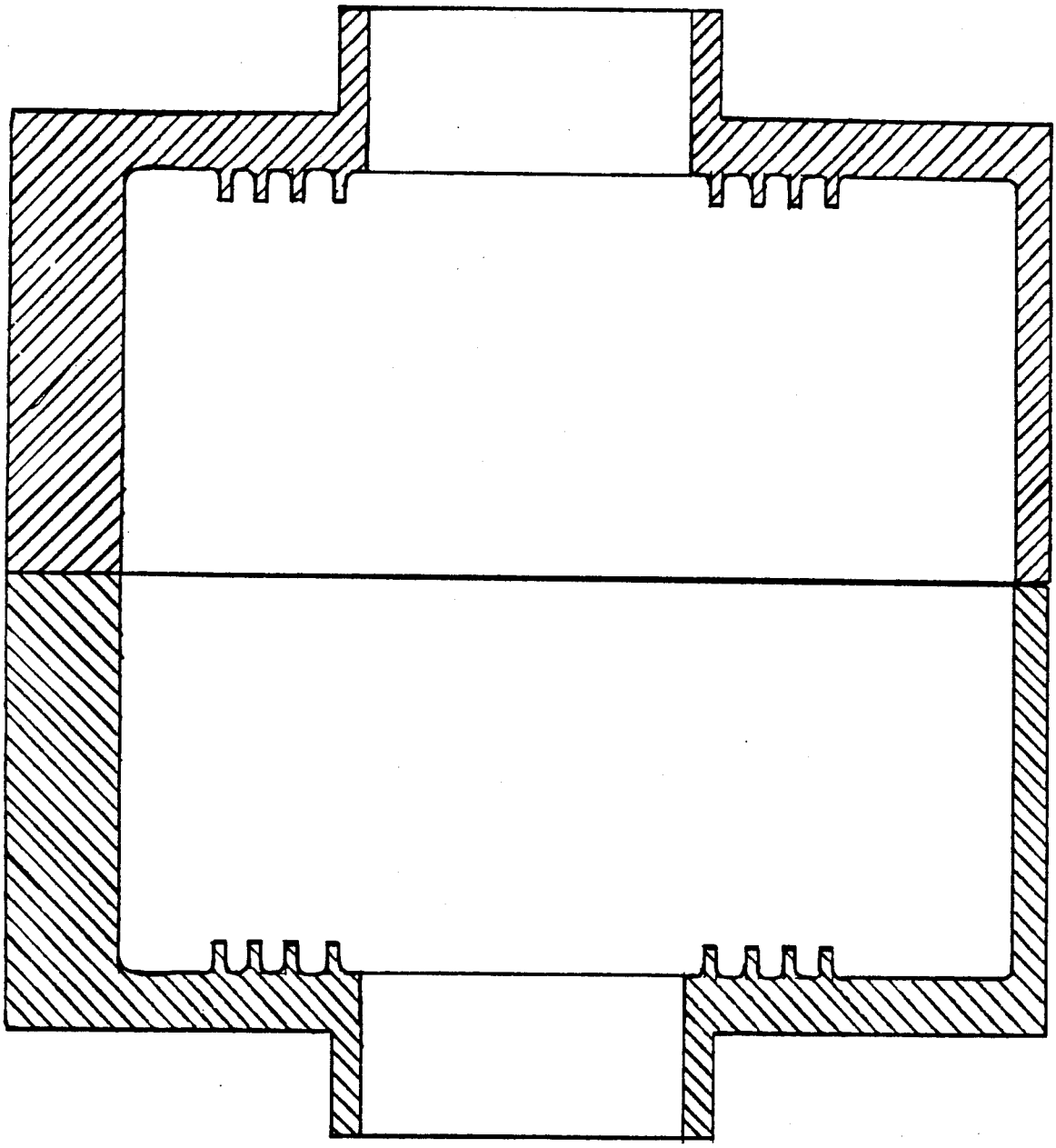

FIGS. 13 and 15 show a vortex mixer which can be scaled to the size required for very large burners, which arranges multiple introduction points of EGR and air, and which is designed to utilize buoyancy instability due to density differences between the relatively warm EGR and the relatively cold air to assist the folding together of the mixants. The vortex mixers shown in FIGS. 13 and 15 can be scaled up to very large sizes, since they are high Reynold's number devices dependent fundamentally upon inertial effects in fluid mechanics. The multiple mixant introduction vortex 13–15 can, with relatively low pressure losses, mix EGR with air down to very fine scales, so that the microscale or molecular scale mixing of air and EGR can be quite homogeneous by the time the air EGR mixture is introduced into a burner. If this is done, very large reductions of $NO_x$ from a heterogeneous combustion process are possible.

Figure 14:
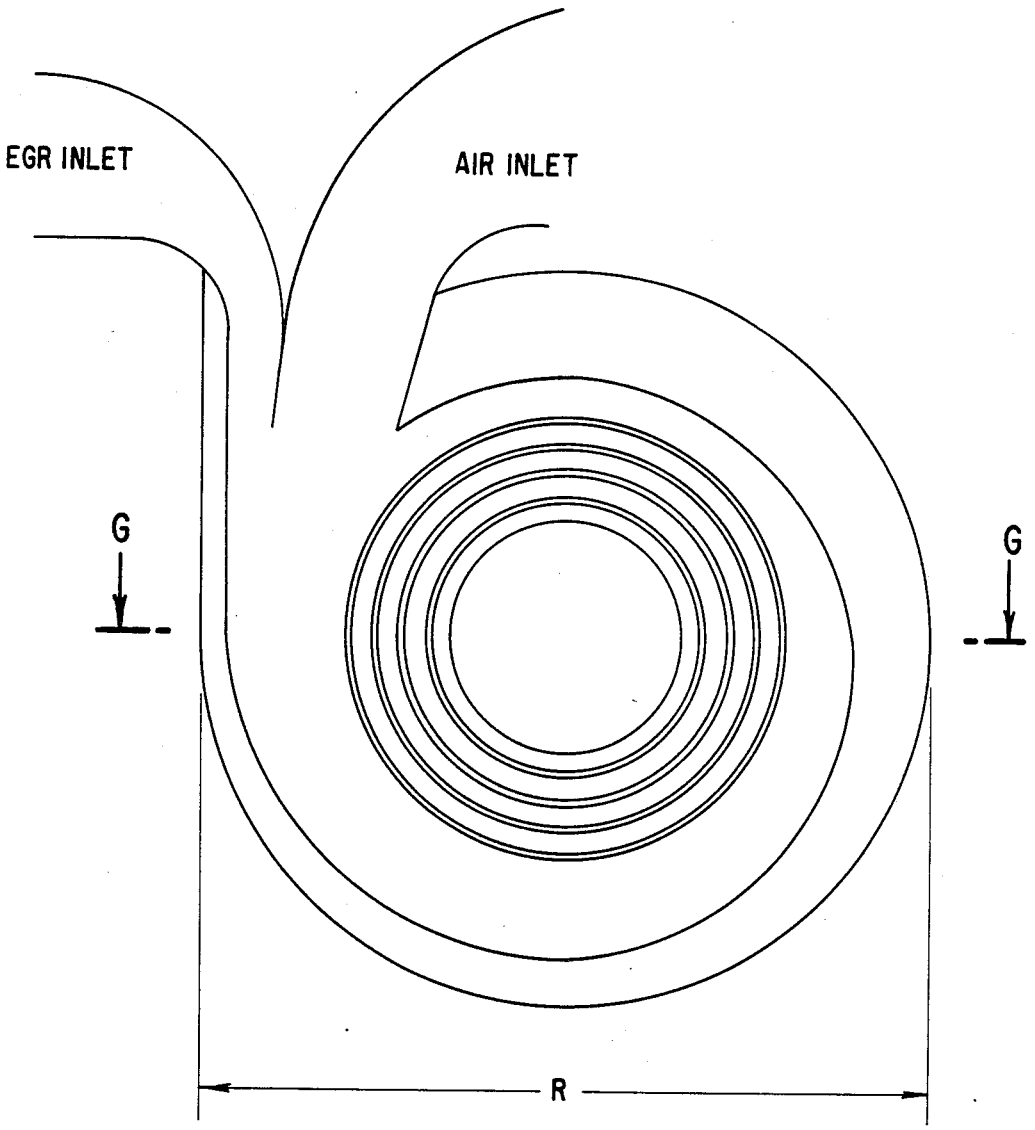

FIG. 14 illustrates an air-EGR mixer with single inlets of air and EGR but with flows arranged for buoyancy instability mixing. The design is applicable to relatively smaller air-EGR mixers.

Figure 16:
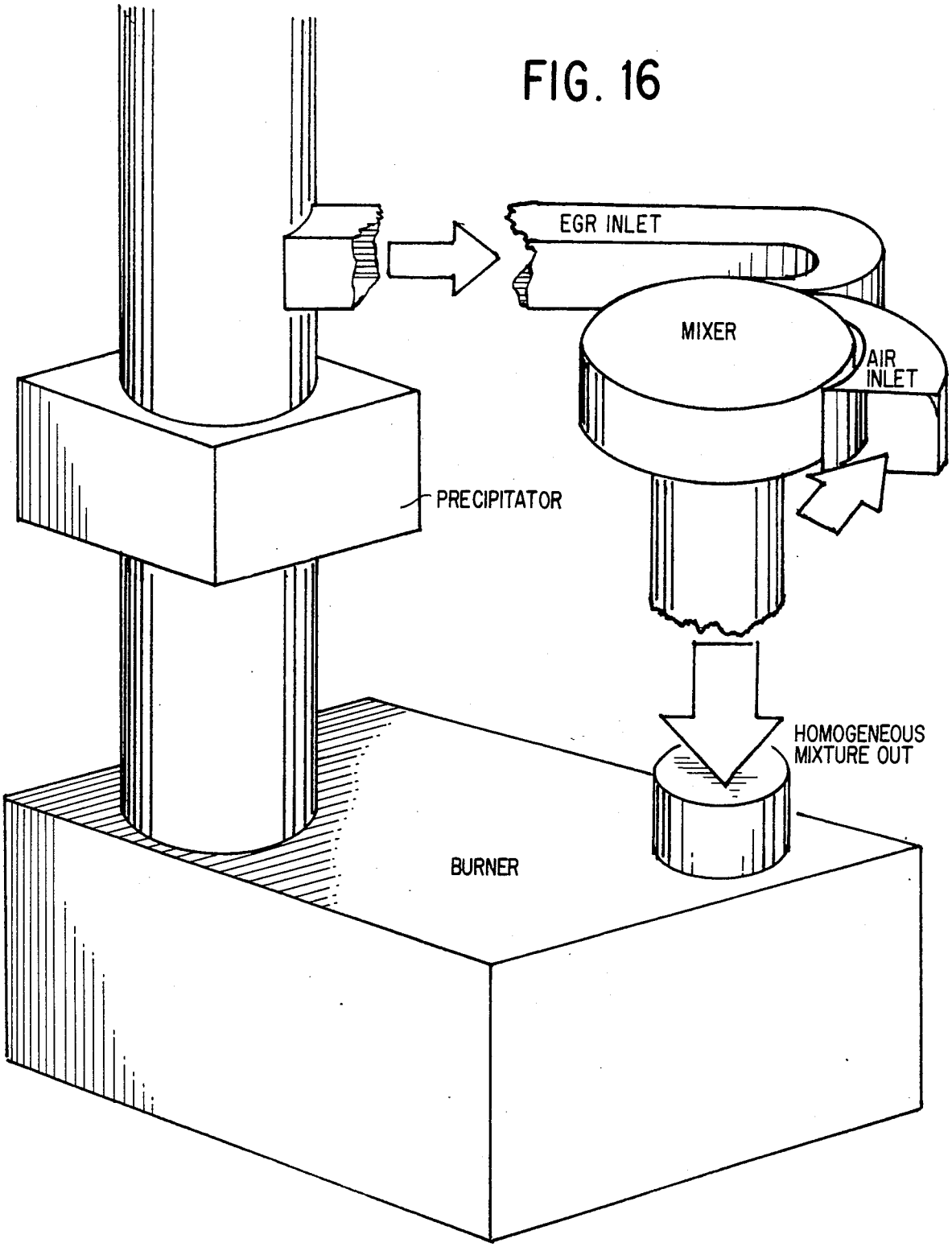

FIG. 16 illustrates the use of vortex mixed ultra-homogeneous EGR air mixers on a power plant burner system. The EGR supply to the burner shown schematically in FIG. 16 is equally applicable to coal-fired, oil-fired or natural gas-fired burners, and applies to large industrial burners of all kinds. For large installations, a mixer analagous to FIG. 13, rather than the simpler FIG. 14 shown schematically, would be used.

Figure 17:
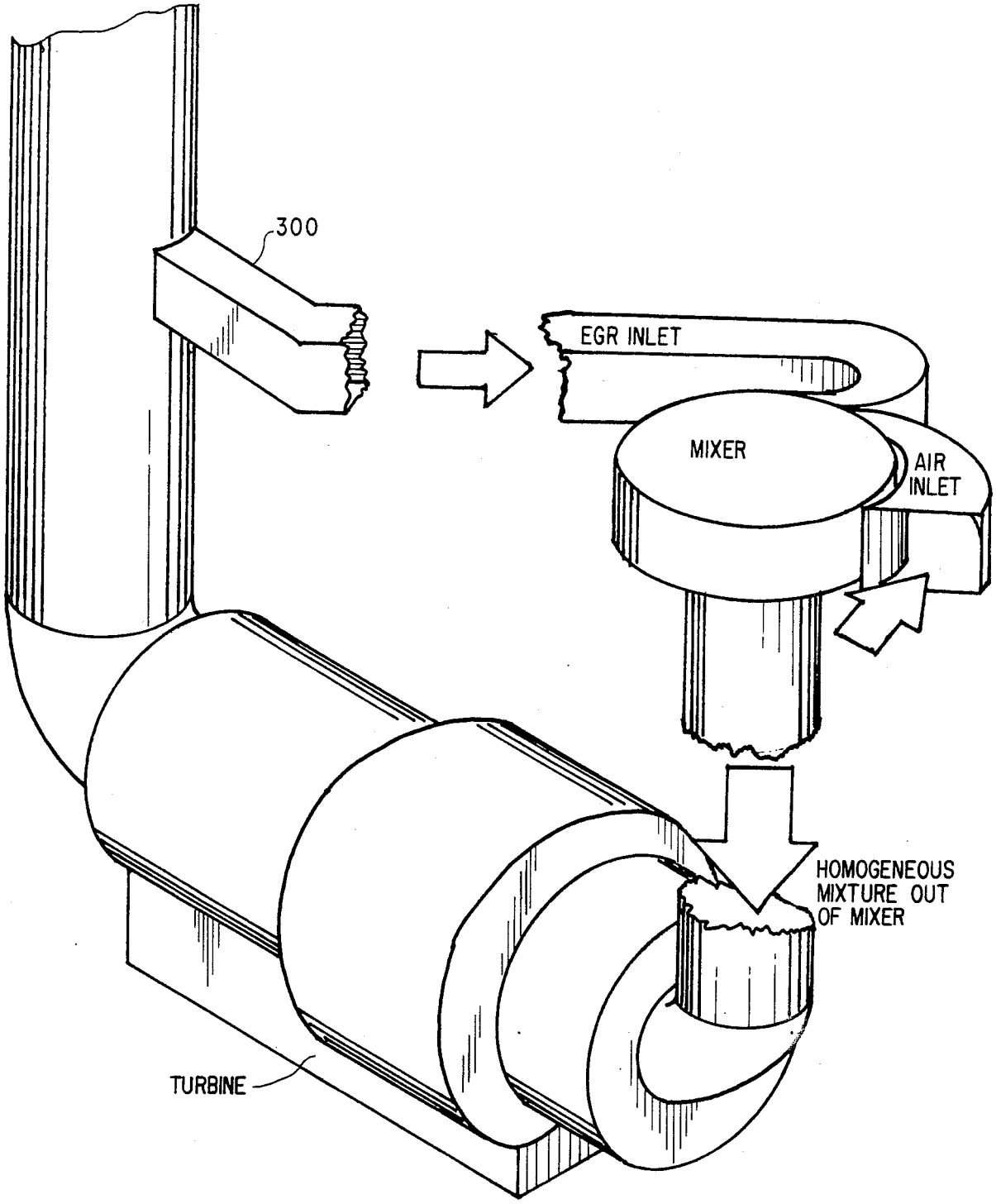

FIG. 17 is a schematic of hardware to supply vortex-mixed homogeneous EGR air mixtures to the intake air of a stationary turbine. The arrangement shown in FIG. 17 is capable of radically reducing $NO_x$ outputs from such stationary turbines. For large installations, a mixer analogous to FIG. 13, rather than the simpler FIG. 14 mixer shown schematically, would be used.

Figure 18:
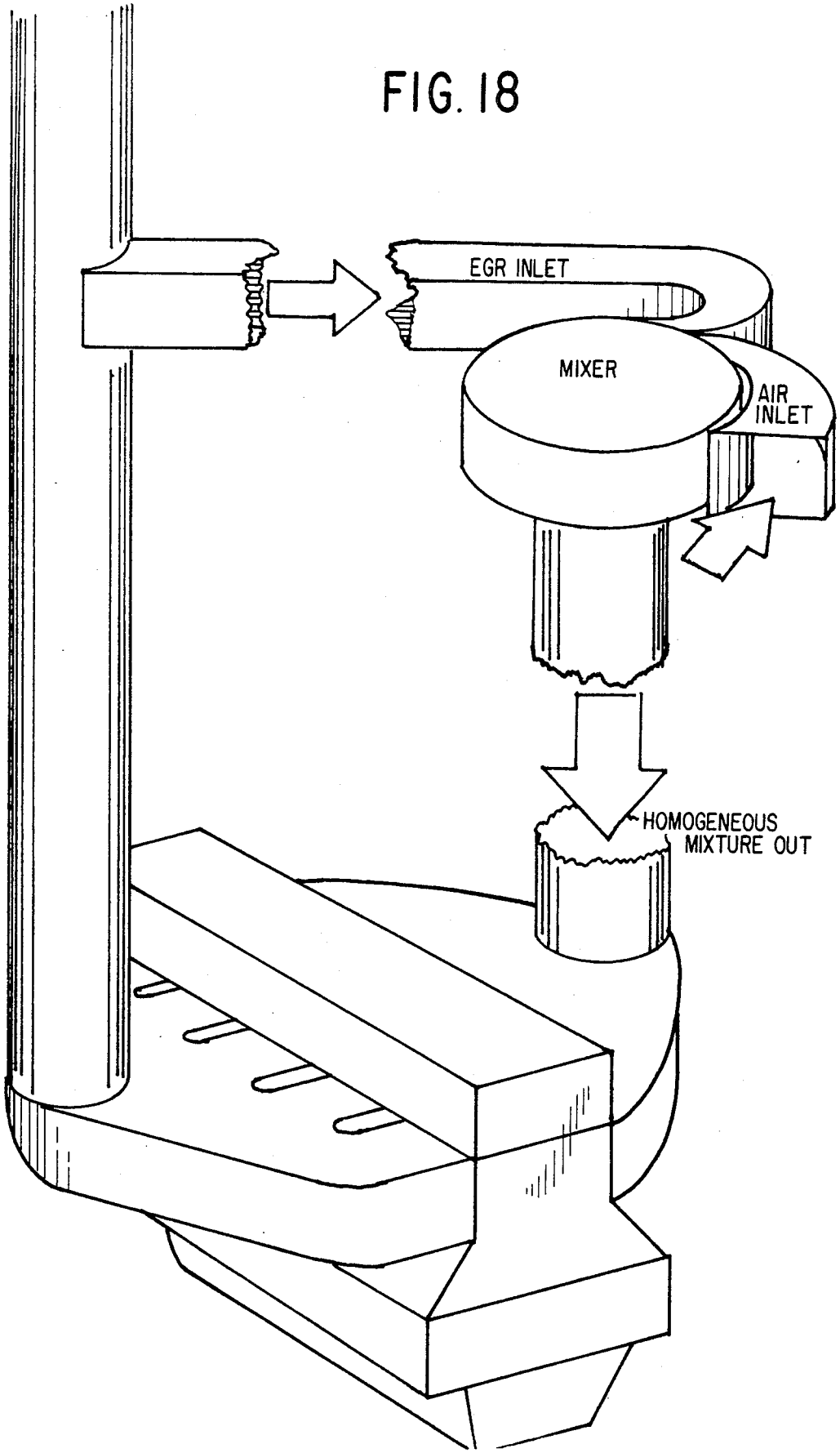

FIG. 18 shows a schematic of a vortex EGR-air mixer supplying an air-EGR mixure to a diesel engine.

This method of $NO_x$ suppression is effective for large $NO_x$ reduction in both stationary and automotive diesels, and makes possible much larger $NO_x$ reductions per unit EGR input than are presently possible. Details of the EGR-air mixer not shown in the schematic would vary with installation size.

DETAILED DISCUSSION

FIG. 1 shows typical $NO_x$ profiles predicted by a mathematical model showing the effects of two-stage combustion and flue gas recirculation on a homogeneous burner (Source: Bartok et. al., Exxon Research and Engineering, 1969, page 312 of *Air Pollution,* Henry C. Perkins, McGraw-Hill Book Company, 1974). The figure shows that Bartok's model predicted approximately a ten-fold reduction in nitric oxide output with a very moderate ten percent EGR percentage, on the assumption that fuel, air, and EGR were homogeneously mixed prior to combustion. The kinetic results predicted in Bartok's model are quite reasonable, but are very different from those obtained with EGR in industrial practice on large burners. A great many large power plant burners are already operating with EGR percentages of ten or more percent (often up to the 20 percent level). These EGR percentages according to conventional kinetics modeling, should produce very large $NO_x$ output reductions. Something like a fifty-fold reduction in $NO_x$ should be possible with 20 percent EGR if the EGR were homogeneously mixed with the intake air feeding the burner. Because air and EGR are not completely mixed, the results obtained with EGR are much worse in practice than those predicted kinetically. For example, in Table 12.11 of Perkin's page 313, op. cit. a result is shown where a 320 megawatt power plant burner was equipped with twenty percent EGR, and $NO_x$ concentrations fell only from 350 parts per million to 150 parts per million. Kinetics calculations indicate that $NO_x$ output from this burner could have been reduced another factor of twenty-five downwards from the 150 parts per million number if the twenty percent EGR in the system had been well mixed with the intake air. In addition, heterogeneity of EGR with the air means not only that there are significant parts of the air stream which are relatively poor in EGR, it also means that there will be lumps of air EGR mixture that have concentrations of EGR much higher than twenty percent. Those familiar with flame stability limits will recognize that these very high EGR percentages may cause combustion difficulties, delaying CO burnout and requiring relatively larger excess air percentages (with attendant stack heat losses) than would be possible with homogenous air-EGR mixing.

The results shown in FIG. 1 are for kinetic calculations which assume fuel/air homogeneity and air EGR homogeniety. It is possible to produce homogeneity of air and EGR according to the present invention, but even so the air and EGR mixture will be used in heterogeneous combustion where local air/fuel ratios will vary within the burner. FIG. 2 illustrates the effect of fuel/air ratio variation on $NO_x$ output for three levels of homogeneously mixed exhaust gas and air. The figure is taken from a computation applied to an internal combustion engine, but is directly relevant to the non-automotive cases. (Source: "Nitric Oxide Emissions from Stratified Charge Engines: Prediction and Control," by Paul N. Blumberg, Ford Motor Company, which has presented at a Combustion Institute meeting in Urbana, Ill., March 1973.) The figures show the general result that the $NO_x$ vs. fuel/air ratio curve shifts down rapidly with increasing EGR (EGR and air are assumed to be homogeneously mixed for the calculation). FIG. 2 applies to an internal combustion engine where adiabatic compression increases flame temperatures. For a burner at atmospheric pressure, temperatures are less and the $NO_x$ curve for homogeneous combustion shifts downward. For a burner at atmospheric pressure the $NO_x$ curve for homogeneous combustion roughly corresponds to the twenty percent EGR curve of FIG. 2.

Chemical kinetics calculations frequently predict that very large reductions in NO output are possible for combustion systems. Since experimental results (usually with bad mixing) often show smaller reductions, the relevance of chemical kinetics to $NO_x$ formation is sometimes doubted. FIG. 3 illustrates the radical reductions in $NO_x$ output possible with complete homogeneous combustion in a spark-fired engine built according to "High Swirl Very low Pollution Piston Engine Employing Optimizable Vorticity," U.S. Pat. No. 4,344,394). The 1000:1 range of $NO_x$ output illustrates the extreme sensitivity of $NO_x$ output to equivalence ratio in this case, where homogeneous mixing was nearly achieved. The data illustrated are strongly consistant with the conventional kinetics mathematical models of $NO_x$ formation, which also apply to other combustion systems. It is the strong opinion of the inventor that deviations of NO output from those predicted by kinetics are almost always the results of mixing imperfections which cause the real combustion system to deviate from the homogeneous assumptions of the kinetics calculations. Because $NO_x$ output of a combustion element can vary by 1000:1 or more depending upon its stoichiometry and EGR percentage (which determine the temperature-pressure-time history which forms the $NO_x$) mixing imperfections can radically change $NO_x$ concentrations from those possible with complete mixing. The $NO_x$ penalty which occurs because of heterogeneity of the air EGR mix supplying a combustion system is very large, and this large penalty is wholely consistant with the kinetic theory of $NO_x$ formation. The quality of mixing of air and EGR in current combustion systems is extremely imperfect in practice. An understanding of how lumpy the mixing process is requires an insight into the lumpiness of the turbulent jet mixing process which is the dominant mixing process in air EGR mixing and other industrial mixing processes.

FIG. 4 shows the extreme lumpiness of conventional jet mixing in a flow visualization photograph of with a laser induced fluorescence illuminating a planar cut across a turbulent mixing jet (Source: Dimotakis, Lye & Papantoniou 1981, reproduced from page 97 of *Album of Fluid Motion,* assembled by Milton Van Dyke, Parabolic Press, Stanford, Calif., 1982). The visualization process of Dimotakis, et. al. makes extremely clear the degree of heterogeneity in the jet, which was much less clear prior to their efforts in 1981. A fluorescently dyed water jet is injected into a relatively quiescent mass of water, and a plane of laser light illuminates the fluorescent material which is photographed at right angles to show a planar cut showing the details of concentrations and flow structure in the jet as the jet flows downward. The planar cut shown is centered on the jet, but like levels of heterogeneity occur at other sectional cuts. The flow in the jet becomes turbulent and unstable, shortly downstream of its ejection, and breaks up into topologically complex vortex sheets and flow patterns. These flow patterns are random in a sense, but have significant degrees of short-term structure. Observing the differences in concentrations shown in the paragraph, it is clear that even thirty or more diameters downstream from the jet nozzle concentration variations in the jet of 100:1 or more still persist. At the visual scale of the photograph, the jet is extremely heterogeneous everywhere. Even many hundreds of diameters downstream from such a jet, the degree of heterogeneity on the tiny scales relevant to chemical kinetics is very great, and there is nothing like an approach to statistical uniformity of concentrations from microscale control volume to microscale control volume. The extreme lumpiness illustrated by the photograph of Dimotakis, et. al. is of more than academic interest. The lumpiness of mixing illustrated in the photograph is characteristic of the jet mixing process which is the basic mixing process in virtually all current combustors and all current commercial mixing sections. In the past it has been commonly believed that a mixture twenty or more diameters downstream of the issue of a jet in a fully turbulent flow would be quite homogeneous. In industry, it is often felt that a turbulent flow assures complete mixing in relatively short distances, and the issue of microscale homogeneity has been either not understood or has been taken for granted. The photograph of Dimotakis, et. al., makes clear that the conventional jet mixing process is lumpy and is a relatively slow way of mixing two fluids. For fundamental reasons, the difficulty of mixing in a jet (or any other geometry) increases with the linear scale of the jet, so that the mixing processes in a large combustion system are intrinsically harder than those in a smaller one. Conventional jet mixing is not satisfactory for producing homogeneous air EGR mixtures with reasonable pressure drops in reasonable spaces. To produce the rapid and complete mixing of EGR and air required, a more organized mixing process than jet mixing is required to produce large-scale, middle-scale and microscale homogeneity of EGR and air.

FIG. 5 shows a sketch of a mixing section of the inventor's covered by U.S. Pat. No. 4,318,386 showing a mixing section which produces such an organized mixing process. The mixing section illustrated in FIG. 5 is covered by U.S. Pat. No. 4,318,386 showing a mixing section, which happens to be designed for an internal combustion engine. The flow pattern within the central chamber 3 of FIG. 5 is an irrotational vortex mean flow pattern which is not characterized by the lumpiness illustrated in FIG. 2 and which produces an organized folding together of mixants with random diffusion occurring only on relatively fine scales to produce mixing rates much faster than those previously thought possible. The vortex mixer illustrated has been successfully used in an internal combustion engine and was on the engine which produced the $NO_x$ curve for gasoline shown in FIG. 3, with the radical $NO_x$ reduction illustrated in that figure. The homogeneity produced by the vortex shown in FIG. 5 is not perfect, but it is much more complete than that in prior art mixing sections applied to engines. The improved mixture homogeneity greatly widened the limits of stable engine operation and permitted radical reductions in $NO_x$, analogous to the reductions in $NO_x$ possible with perfect mixing of EGR and air in large burners.

See FIG. 5. A generally rectangular throttle plate 1 is in rectangular section 2 and feeds a vortex mixing chamber 3. High speed flow, in the form of wall attached jets, enters tangentially into the vortex mixing section at 6 and 7, and swirls around the outlet 4 in a flow field which is turbulent, but which has the mean flow streamline pattern of the flow field closely corresponding to that of an irrotational vortex. This is the basic vortex mixing pattern useful to homogenize air and EGR for heterogeneous burners. The mixing section involves high Reynolds number flows, and the linear scale of the mixing section can be scaled-up indefinitely with the main features of the flow pattern maintained. Although details in geometry should change with scale because of engineering convenience, if a mixture of air and EGR were fed into the throttle plate 1 the EGR air mixture of the outlet 4 would be relatively homogeneous, and would be much more effective at suppressing EGR in a heterogenous burner than would less mixed EGR. For a large power plant burner, the diameter of the mixing vortex section might be in the neighborhood of ten feet. A vortex mixer appropriate to very large scales and to the mixing of a single phase (such as EGR and air), is described with respect to FIGS. 13, 14 and 15. However, prior to this discussion it is useful to follow the fundamental argument of structured turbulent flow mixing.

Figure 6:
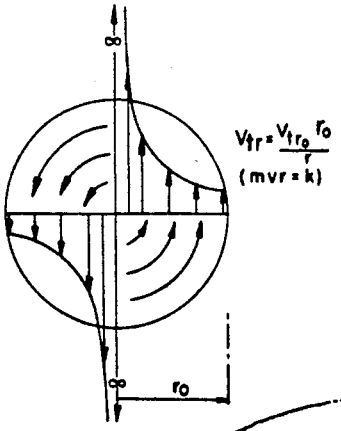

FIGS. 6, 7, 8, 9, 10, 11, 12 and 12*a* illustrate the vortex flow pattern useful for mixing and illustrate the fundamental arguments of structured turbulent flow mixing. FIGS. 6–12*a* are also 6–12*a* in U.S. Pat. No. 4,318,386 by the present inventor with K. W. Kriesel and C. L. Siewert. See FIG. 5 and consider polar coordinates centered at the center 9 of the outlet 4 so the flow velocity components would be defined in terms of a velocity in the radial direction $V_{tr}$ and a velocity in the tangential direction, $V_t$. These velocities would be mean flow stream velocities: the real flow would clearly include a fluctuating component in both the tangential, the radial, and the axial direction. Flow into the vortex chamber from 5 or 6 would clearly have angular momentum with respect to the outlet center 9. Conservation of angular momentum, $MV_tR$, dictates the increase in the tangential velocity of the fluid as it flows towards the center. It is easy to verify that the velocity in the tangential direction as a function of radius r, $V_{tr}$ will be expressible according to the relation $$V_{t(r)} = V_{tro} ro/r$$

where $V_{tro}$ is the tangential velocity at the outside of the vortex, $r_o$ is the radius at the outside of the vortex, and r is the radius where the tangential velocity is taken. FIG. 6 illustrates the flow velocities which are produced in an irrotational flow vortex according to the above equation. The relation is not valid for FIG. 5 for radii inside the outlet 4, but the equations describe the flow field in the annulus between wall 10 and outlet 4.

Because the flow is proceeding from the outside of the vortex to a sink at the center of the vortex, the mass flow rate in the radial direction through any cylindrical cut of the vortex section will be the same (outside of the outlet) so that the radial velocity will therefore vary inversely with the radius for a mixing chamber 3 of constant axial height.

$$V_{r(r)} = V_{rro} ro/r$$

where $V_{r(r)}$ is the radial velocity at radius r, and $V_{rro}$ is the radial velocity at the outside radius of the vortex.

Clearly, the above two equations are of the same form. It follows that for a set tangential velocity input the ratio of the velocity tangential to the velocity raidal will be constant for all the radii. A the constant pitch inwardly flowing spiral pattern therefore occurs for a vortex chamber of constant axial height. If axial height of the mixer varies, the spiral pitch will vary inversely as axial height as a function of radius.

The mean flow streamline pattern described above is a good approximation of the real flow in a vortex mixer such as that shown as mixing chamber 3 if certain fluidic details are tended to. So long as turbulence levels are not too high and boundary layer flows adjacent the top and bottom of the mixer are controlled, the physical relations of conservation of angular momentum make the mean flow streamlines in the real flow rather close to the pattern of an irrotational flow vortex. In the real flow pattern the mean pattern has relatively fine scale turbulent perturbations superimposed upon it. The large, relatively heterogenous lump eddies shown in FIG. 4 do not occur in the vortex flow, since the flow strain pattern of the vortex tends to "comb out" any large eddies. The vortex flow combines large scale patterning with fine scale turbulence and is useful for mixing.

It should be clear that drag interactions between successive radial elements will tend to reduce the velocity increase of the flow as it flows towards the center because the angular momentum as the flow flows towards the center will decay because of these drag losses. Too much flow turbulence can increase these drag interactions to the point that the irrotational vortex flow pattern is destroyed. For this reason, the entrance section of a vortex mixer must be designed with care, so that the flow delivered to the vortex chamber is not too turbulent. Nonetheless, the irrotational flow vortex form, as a flow mode, is extremely stable, and is representative of the flow inside a properly designed vortex mixer over its full operating range. This irrotational flow pattern is a high Reynolds number, high inertia flow pattern which is stable from sizes small enough to feed a small engine to the very large sizes required for an air-EGR mixer for a large power plant.

Figure 7:
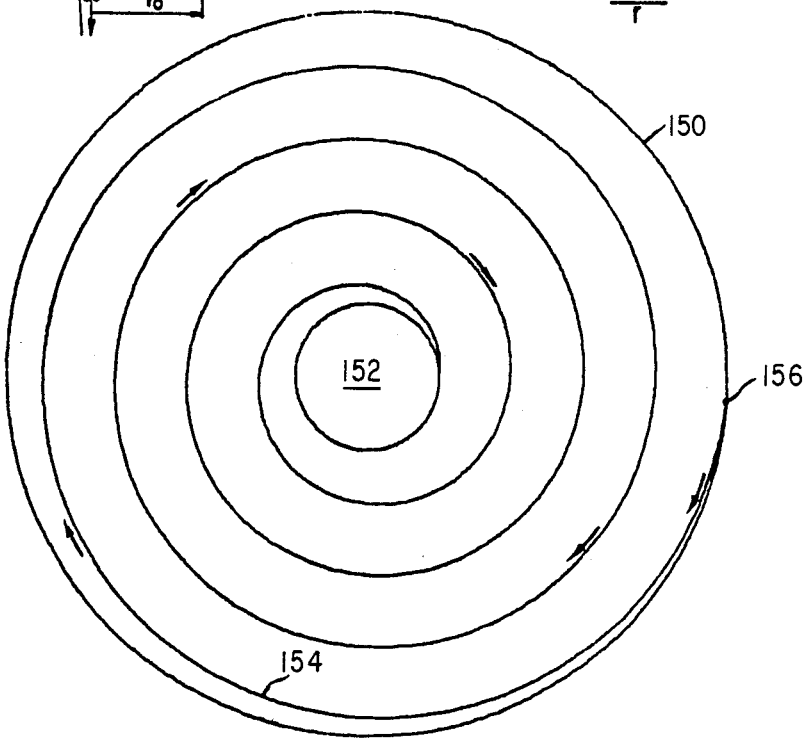
Figure 8:
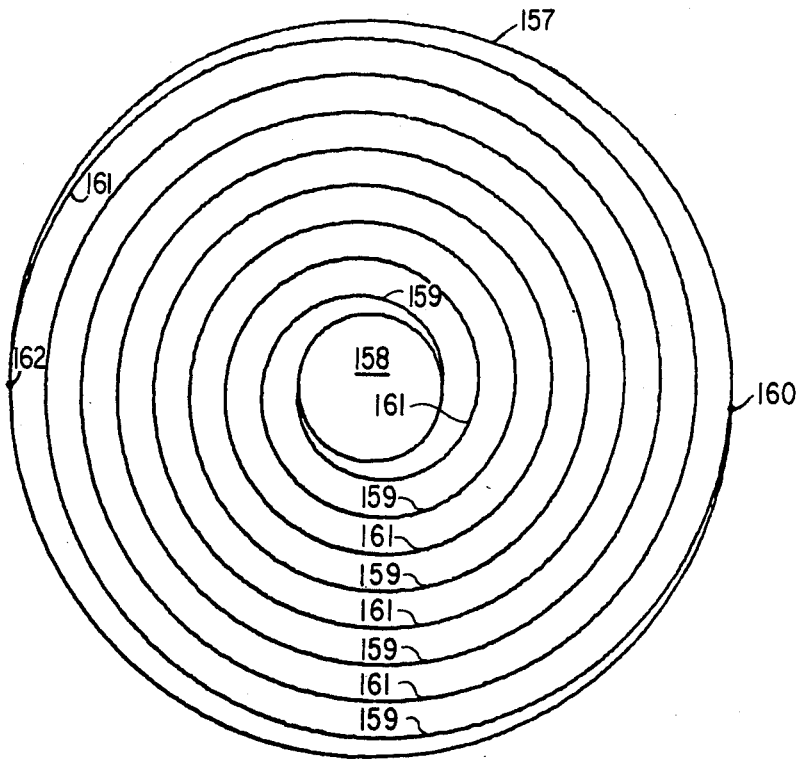
Figure 9:
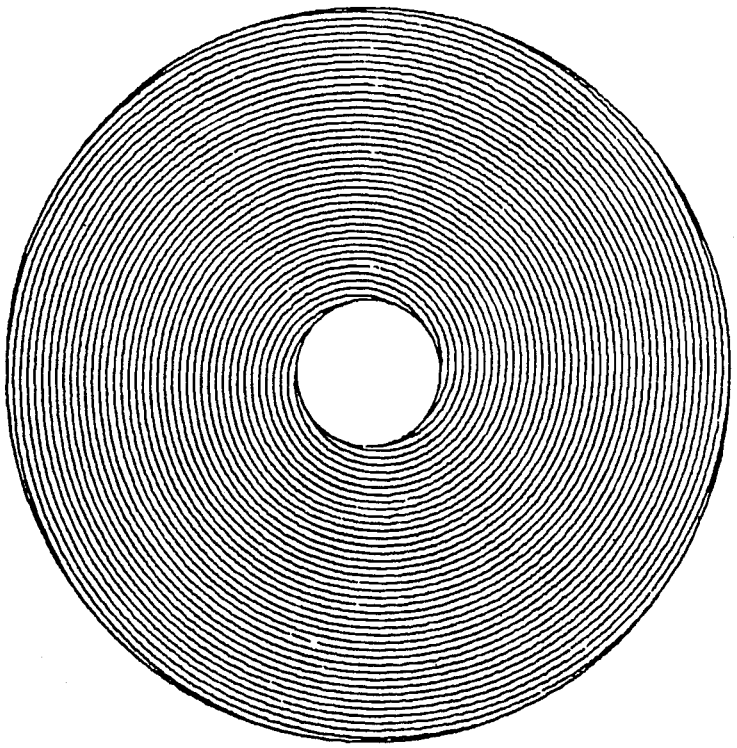

The interaction between mean flow streamlines and turbulence is a most important one if one is to understand mixing. We will be considering here turbulence levels small enough that they do not destroy the basic irrotational vortex pattern. A consideration of FIGS. 8 and 9 should clarify some of the points important with respect to understanding of the interaction between flow structure and molecular and turbulent diffusive mixing. It should be emphasized that the graphical illustration of FIG. 7, FIG. 8, and FIG. 9 are exemplary only. However, the examples are important ones.

FIG. 7 shows a streamline 154 of a vortex from an outside radius 150 to a sink 152 where the streamline obeys the flow equations previously discussed. This flow streamline would occur, for example, in an irrotational flow vortex where the streamline was well away from entrance condition pertubations and where turbulence in the vortex was zero, if one were at point 156 to introduce, for example, ink into a water vortex and watch the ink line as it flowed inwardly to the sink. The streamline, in other words, shows what the flow path would be in the absence of any random mixing, either by turbulent diffusion or by molecular difusion. If there were any diffusion, the width of the line would increase as it flowed inwardly towards the sink, as should be clear to those who understand mixing. In summary, FIG. 7 would show a flow streamline for an irrotational flow vortex if a line of mixant was introduced at only one point along the outside of the vortex and in the absence of either molecular or turbulent diffusion.

FIG. 8 shows what would happen if the same flow situation as that of FIG. 7 had an additional line of mixant introduced 180° around from the initial point of introduction. The vortex would have an outside circle 157 and a sink 158. At point 160 along the circle 157 a line of mixant would be introduced 159. The numbers 159 are shown as the flow swirls in towards the sink to identify that streamline. 180° from point 160 along circle 157 mixant is introduced at 162 and produces flow streamline 161. Flow streamline 161 is identified at several points to make it clear the manner in which the spiral 159 and the spiral 161 nest.

Again, FIG. 8 illustrates what would happen in a mathematically perfect irrotational flow vortex with a sink, in the absence of either molecular diffusion or turbulent diffusion.

FIG. 9 is analogous to FIG. 8, except now, rather than having two nested spiral streamlines, mixant would be introduced evenly around 10 points around the circumference of the vortex; and therefore, 10 different spiral lines would nest as shown.

With respect to FIGS. 7, 8 and 9, it should be clear that the presence of small-scale turbulent perturbations and molecular diffusion would tend to thicken out the lines as they flow from the outside towards the sink of the vortex and therefore that the mixing pattern would be more and more homogeneous as the mixture flowed inwardly towards the sink of the vortex. For example, with respect to FIG. 9 it should be clear tha only a relatively small spreading angle of the mixant lines (corresponding to a relatively small turbulence intensity) would so smear out the lines of mixant by the time the flow had spiraled from the outside of the vortex to the sink, that the mixture at the sink of the vortex would be homogeneous down to relatively fine scales. The mixing process folds the fluids together in a controlled shear flow that serves to "comb out" large lump eddies such as those shown in FIG. 4, and acts to shuffle fluid elements so that the mean distance across which diffusion needs to occur in order to achieve essentially perfect homogeneity at the vortex sink is very short.

A consideration of the turbulent or molecular diffusion differential equation should make clear that an n-fold decrease in the mean distance across which diffusion needs to occur, for a set interfacial area, will decrease the time required for equilibrium by a factor of n. But the effect is even stronger. Introduction of mixant from many points around the periphery of the vortex is tantamount to increasing the interfacial area across which diffusion can occur. Of course, this effect increases mixing rates too. Again, it must be emphasized that the flow streamlines shown in FIGS. 7, 8 and 9 are only exemplary. However, the geometrical relations with respect to mixing illustrated by these figures are extremely important and do not become less important as the flow streamline structures become more complex. For any given high strain flow structure, the flow structure will serve to stretch out the concentration gradients of species to be mixed and therefore, the flow structure will dramatically affect the rate at which the mixing proceeds. Mathematically, the flow structure, or non-random streamline pattern, can be thought of as a spatial transform of concentration fields as a function of time. There are flow transforms which are very conducive to mixing. The irrotational flow vortex is such a flow transform. However, it should be clear that many other flow patterns which are not exactly irrotational flows can also have flow patterns very much conducive to mixing. For example, the flow pattern in the vortex of the present invention will not be a perfect irrotational flow vortex. However, with respect to the spiral streamlines, it will differ from a conventional irrotational flow vortex only in that the ratio of tangential to radial velocity will not quite be constant as a function of radius for the real flow.

The basic irrotational flow mixing process should now be clear, and it should be relatively clear that the function of the device rests on the interaction of molecular diffusion, turbulent difficusion, and the gross effects of the flow structure. However, it should be said that the flow structure which is most desirable requires a bit of design care. Vortex flow patterns analogous to those required for mixing have been used for many years in fluidic diodes for information handling and other purposes. For a detailed discussion of vortex devices, see Chapter 8 of *Design Theory of Fluidic Components,* by J. M. Kirshner and Silas Katz, Academic Press, 1975. FIGS. 10 and 11 are taken from pages 281 of this book and show the flow pattern which can be produced if top and bottom boundary layer circumferential grooves are not used. FIG. 10 is a view of the flow perpendicular to the axis of rotation of the vortex, the FIG. 11 is a diametral section showing streamlines for the flow of FIG. 10. What is called the developed region (or doughnut) is caused because of a boundary layer effect. The centrifugal forces in the flow in the vortex are important to determining the flow pattern. Centrifugal force is proportional to $r\theta^2$, and is therefore proportional to velocity squared. At the top and bottom surfaces of the vortex-containing channel, viscous forces slow down the flow in and near the boundary layer. This means that the centrifugal force in the vortex near the wall is much less than it would be in the center, and the result is that the radial velocity of flow towards the sink is greater near the walls of the vortex than it is in the vortex center. The effect is so large that the recirculating doughnut flow shown in FIGS. 10 and 11 often occurs. One of the difficulties is that this doughnut flow diameter will vary with the Reynolds number at which the device is operating and as the ratio of radial velocity to tangential velocity varies and so can produce unfortunate modal characteristics with respect to the mixing device. Clearly, the simple irrotational flow vortex flow form is a preferable flow form. It has better mixing rates, it is simpler, and its equations are not modal, so that the irrotational flow vortex will be stble above a certain minimum Reynolds number. To achieve this approximation of the irrotational vortex flow pattern, it is necessary to condition the boundary layer flows on the top and bottom surfaces of the vortex mixing chamber.

This boundary layer control can be obtained with circumferential grooves such as those shown in FIG. 12 and FIG. 12*a*. FIG. 12 shows the flow pattern which is produced due to these grooves where FIG. 12 is a diametral half section of a vortex channel such as that shown in Figure and shows the velocities with respect to the radial direction (it should be clear that very significant tangential velocities, which are not shown in FIG. 12, also exist in and out of the pattern). The effect of the circumferential grooves 81 is to stabilize small vortical flows between the weirs in such a manner that the effective boundary layer flow is well lubricated and where the great bulk of the flow energy in the vortex is in the form of a simple irrotational vortex flow. It should be emphasized that the device will produce significant mixing without circumferential grooves such as 81. However, operation with the grooves is preferable.

FIG. 5 shows a sketch of a mixing section of the inventor's covered by U.S. Pat. No. 4,318,386 showing a mixing section which produces such an organized mixing process.

Referring again to FIG. 5, the performance of the mixer in FIG. 5 should be relatively clear. In the automotive vortex mixer of FIG. 5, the system is designed to take advantage of the full throttling pressure drop of the engine, which may be large since gasoline engines are controlled by throttling. The mixer of FIG. 5 is also characterized by a fuel evaporation function which is not relevant to air-EGR mixing. The mixer shown in FIG. 5, and its predecessors, have demonstrated the practical usefulness of vortex mixing for achieving very fine scale homogeneity. Water model Reynolds analogy modeling of the flow, using both salt and visible ink as tracer, has shown that the mixing in the vortex geometry of FIG. 5 is extremely rapid, is constant with the theory described in FIGS. 6–9, and scales conveniently to high Reynolds numbers which are relevant to larger mixing sections.

FIGS. 13 and 15 show generally a kind of vortex mixer which can be scaled to the very large sizes required for power plant burners. FIG. 13 shows a large scale mixer with an inlet where nine EGR introduction lines are placed between ten air introduction lines so that a relatively "striped" flow enters tangentially into the vortex to produce mixing analogous to that shown in FIG. 10. FIG. 15 is a section view on either FF of FIG. 13 or GG of FIG. 14 showing the top and bottom of the vortex, particularly illustrating the circumferential grooves rrequired for boundary layer control and discussed with respect to FIGS. 11, 12 and 12*a*.

See FIG. 13, which is a schematic of the flow section which can be used to mix air and EGR in a very large stationary power plant. R in FIG. 13 could be as large as ten feet. The axial height of the vortex mixing section could be ten feet or so also, particularly since the central vortex sink can take fluid from both the top and bottom relatively planar surface of the mixing section as shown in FIG. 15. Flow is introduced into the vortex mixing section at relatively contracted passage 210, where the tangential velocity drives an irrotational vortex in mixing chamber 211 in the manner described previously. The vortex flow in chamber 211 is an inwardly spiraling roughly two-dimensional structured flow streamline turbulent flow spiraling inward to outlet 213. Upstream of tangential nozzle 210 in a relatively enlarged passage is a set of passages 220 and 222 which introduce roughly rectangular jets of EGR relatively evenly into an airstream, so that the air-EGR concentrations flowing from header section 220–222 to nozzle 210 form a roughly "striped" concentration pattern in two dimensions for any set axial cut through the mixer. This "striped" concentration pattern flows into the vortex and is mixed in a structured turbulent flow mixing process analogous to that shown in FIG. 10.

Following the argument presented with respect to FIGS. 7, 8 and 9, it should be clear that increasing the number of "stripes" of EGR injected into the air stream will, by reducing the mean distance across which turbulence and molecular diffusion must act to mix, substantially increase the mixing rates in a vortex. It might be possible to get substantial mixing simply by plumbing many injection points of EGR into the air stream of a conventional conduit, but the lumpy nature of the jet mixing process makes this far less effective than mixing in a structured flow such as the vortex, which has flow stains which serve to "comb out" the large eddies characteristic of jet mixing so that homogenization on very fine scales can proceed. Those skilled in the fluid mechanical arts should recognize that it should be straightforward to control the mean concentrations of EGR and air directly downstream of an injection section such as 220–222 even for extremely large section sizes, since the flow can be "organized" with relatively minor pressure drops. It should be clear to those who understnad mixing that very rapid mixing rates may be obtained with a large number of "stripes" of EGR-air introduction in an entrance section feeding a vortex. The mixing will improve continuously as the number of "stripes" is increased, and the optimal trade-off between number of EGR injection stripes engineered into header assembly 220–222 will vary from installation to installation depending on installation size and economics. Using the basic geometrical approach illustrated in FIGS. 13 and 15 it is possible to homogeneously mix EGR and air (or any other two fluids of the same phase) at any scale of commercial importance to man.

With respect to air-EGR mixing in a vortex, the inertial forces in the vortex are important to consider. Even for rather large section passage radii, the radial acceleration of the fluid in the vortex, $A_r=r^2$, is significant. This radial acceleration of the fluid will serve to set up body forces on fluid elements which will vary with density. Since the air-EGR mixing process mixes fluids at different temperatures with different mean molecular weights the EGR and air will usually have different densities. These density differences in the inertial field will drive a buoyancy instability which will serve as a source of turbulence tending to mix the fluids in the vortex. This turnover buoyancy instability will act to homogenize the air and EGR on both relatively large and fine scales.

For relatively small radius vortices (such as could occur on a diesel engine) the buoyancy instability can be very large. FIG. 14 illustrates a vortex mixer for mixing air and relatively hot EGR in a situation where inertial forces in the vortex are important, and utilizes buoyancy instability. EGR is introduced into the section at the outside of the vortex, and the airflow is relatively more inward when it is injected tangentially into the vortex flow. Because the air is cooler and denser than the EGR, there will be a turnover effect which will produce homogenization of the air and EGR, and will superimpose on the structured turbulent flow mixing processes described qualitatively with respect to FIGS. 7–9.

The mixant introduction patterns of FIG. 13 and 14 show two alternative cases. In FIG. 14 one layer is introduced for each mixant and density instabilities are relied on to produce some of the mixing. In FIG. 13 the mixants are initially introduced in a large number of alternating "stripes". It is clear that the mixing rates will increase in the vortex with the number of "stripes" and buoyancy instabilities will be useful in mixing air and EGR both in the few stripe and many stripe cases. Vortex mixers such as those shown in FIGS. 13, 14 and 15 can be scaled over a wide range of sizes, from the relatively small vortex EGR mixer useful for mixing EGR in an automotive diesel to the very large air-EGR mixing section applicable to a thousand megawatt power plant installation. On all scales, the design of an air-EGR mixer using vortex mixing is relatively straightforward, so that it is possible to deliver to any heterogeneous combustion system a quite homogeneous mixture of EGR and air. If this air is used in a heterogeneous combustion process, no matter what the heterogeneous combustion process is, very large reductions of $NO_x$ formation rate can be obtained. For reasons described previously, the EGR reductions obtainable with the *mixed* air-EGR can be an order of magnitude or more greater than those which occur without careful air-EGR mixing.

A number of considerations with respect to the design of air-EGR mixers should be clear to those skilled in the mechanical and fluid mechanical arts. It is clear that the detailed structural design of a vortex mixer will be very different for a huge power plant and a mixer designed to mix air and EGR for a diesel automotive engine. The mixer useful for the diesel may be an assembly of die castings. For the power plant the vortex mixer would be assembled on site, and would be made of sheet metal with many welded supports. For both sizes of mixer, operating temperatures are not very high, since the EGR-air mixture is unlikely to be much hotter than 300° F. in normal cases. It will be easier to obtain durability of the vortex mixer if it is always operated at a temperature above the dew point of the homogeneous air-EGR mixture which it is intended to produce.

The economic and engineering significance of system pressure drop will vary with air-EGR mixer scale and application. As the tolerable pressure drop across the mixing chamber increases, mixing rate increases as roughly the square root of the pressure drop. For lower pressure drops, more multiple introduction points of air and EGR will be required to obtain the same mixing quality.

Most of the pressure drop (usually more than 95 percent) across the vortex mixer will be available in the form of kinetic energy of the rotating flow at the vortex outlet. It is possible to reduce the net pressure drop across the mixing chamber, and obtain some additional mixing, by using a diffuser to convert the high velocity flow to a lower velocity flow at a higher pressure. The engineering details and optimal design for a vortex diffuser will vary with the scale of the vortex mixer itself. These diffuser design issues are not the subject of the present application.

FIGS. 16, 17 and 18 show vortex mixed ultra-homogeneous EGR applied to a number of heterogeneous combustion systems. In each of these heterogeneous combustion systems, fuel/air ratio varies greatly from place to place within the volume where burning occurs, and temperature-pressure-time trajectories which determine NO formation vary accordingly. However, if at each microvolume in the burner the air-EGR ratio is a set value, the peak flame temperature in the burner will be lower for *every* element of fuel/air mixture burned because *every* element of fuel/air mixture will have the same ratio of diluent to air, and this EGR diluent, because of its specific heat and mass, will suppress peak flame temperatures. This lowering of peak combustion temperatures will occur in every element to be burned regardless of the details of the fuel-oxider mixing process in the burner. It should be clear that control of $NO_x$ via air-EGR mixing is also convenient since EGR and air can be mixed at relatively low temperature and the homogenized EGR-air can be supplied as the intake air of the heterogeneous combustion system with relatively simple plumbing. Because NO formation rates are so temperature sensitive, the homogeneous lowering of combustion temperatures which occurs with homogeneous EGR-air mixing will greatly reduce NO output. The magnitude of the obtainable reduction can be estimated straightforwardly by kinetics calculations such as those shown in Bartok, op. cit. integrated over a range of air/fuel ratios (for convenience it is well to choose the air/fuel ratio distribution as a Gaussian about the mean air/fuel ratio). The degree of $NO_x$ control obtained increases with increasing EGR, and more than ten-fold reductions can be readily achieved.

FIG. 16 illustrates the use of vortex mixed ultra-homogeneous EGR-air mixes on a power plant burner system. The EGR is taken just downstream of the electrostatic precipitator and is introduced into a vortex mixer which is shown schematically without multiple "stripe" introduction, but which is intended to mix EGR with air in the manner described in FIGS. 13 and 15. The homogeneous intake air-EGR mixture is then fed as the "primary air" into the burner, which could be a natural gas or oil or coal burner. The arrangement shown schematically in FIG. 17 is capable of radically reducing $NO_x$ outputs from large industrial and electric power plant burners, including the biggest ones. Most large power plant burners are already equipped with EGR. Homogeneous mixing of this EGR with the feed gas air substantial abatement of $NO_x$ can be combined with somewhat improved combustion characteristics in the burners.

FIG. 17 is a schematic of hardware to supply vortex mixed homogeneous EGR-air mixtures to the intake air of a stationary turbine. Some exhaust gas is picked up at 300 and recirculated with intake air in a vortex mixer analogous to that shown in FIGS. 13 and 15. Again, the schematic does not illustrate the "multiple stripe" introduction required for complete mixing in large installations. The vortex mixing section homogeneously mixes the air with EGR to scales so fine that the air-EGR mixture is effectively homogeneous on micro-scales by the time it passes as the supply air into the turbine and combines with fuel in the can combustors inside the turbine. The arrangement shown in FIG. 17 is capable of radically reducing $NO_x$ outputs from such stationary burners for a set level of EGR. The homogeneous mixing of air and EGR illustrated schematically in FIG. 17 will also increase the tolerable EGR percentage from a combustion point of view. The arrangement shown in FIG. 17 is capable of radically reducing $NO_x$ outputs from such stationary turbines. The inventor estimates that more than 95 percent $NO_x$ abatement can be achieved without any efficiency penalty.

FIG. 18 shows a schematic of a vortex EGR-air mixer analogous to that of FIG. 14 supplying an air-EGR mixture to a diesel engine. The method of $NO_x$ suppression illustrated here is effective for large $NO_x$ reduction in both stationary and automotive diesels, and makes possible much larger $NO_x$ reductions per unit EGR input than have been possible with previous diesel engine EGR supplies. For large diesels, the "multiple stripe" introduction of EGR illustrated in FIG. 13 will be required, rather than the single point introduction illustrated in FIG. 14, which should produce effective $NO_x$ control for smaller diesels.

The $NO_x$ suppression technique described above is applicable to any heterogeneous combustion process. By homogeneously mixing air and EGR using the organized structured turubulent flow mixing process illustrated here it is possible to practically and economically obtain the large $NO_x$ reductions predicted for EGR by kinetic calculations.

I claim:

1. A technique for achieving calculated $NO_x$ reductions from EGR in heterogeneous combustion systems comprising a burner where fuel and oxidizer are heterogeneously mixed and burned and wherein the products of such burning are cooled to produce useful energy and said products of combustion, called exhaust gas are available in a duct at relatively moderate temperatures, ducting means whereby a fraction of said exhaust gas is recycled into the intake air supplying said burner and whereby the mixing of air and EGR is accomplished with a vortex mixer wherein alternate layered bodies of air and EGR are introduced into the entrance upstream of the vortex so that the high shear structured turbulent mixing process of the vortex acts to produce microscale homogeneity for very large scale mixer sections.

where this homogeneous air EGR mixture is called oxidizer, and where this oxidizer is fed as the total oxidizer supply to the heterogeneous burner, whereby the peak flame temperatures in the heterogeneous combustion process are lowered for all microvolumes in the burner and so that the rates of NO formation in all of these microvolumes are small so that the total $NO_x$ output of the burner is suppressed to a level approximating the NO output which would be predicted calculating combustion with homogeneous microscale mixing of air and EGR and a statistical distribution of fuel oxidizer ratios.

2. The invention as described in claim 1, and wherein the burner is a coal fired burner.

3. The invention as stated in claim 1, and wherein the burner an oil burner.

4. The invention as stated in claim 1, and wherein the burner is a natural gas burner.

5. The invention as stated in claim 1, and wherein the burner is a large natural gas reciprocating piston engine.

6. The invention as stated in claim 1, and wherein the burner is the combuster can of a stationary gas turbine engine.

7. The invention as stated in claim 1, and wherein the burner is the hetergeneous combustion chamber of a diesel engine.

8. The invention as stated in claim 1, and wherein the vortex mixer is adapted to produce mixing by the superpostition of the vortex mixing with bouyancy instability to obtain a relatively homogeneous air EGR mix.

9. The invention as stated in claim 1, and wherein the vortex mixer described utilizes a pressure drop across the vortex to drive the irrotational vortex flow and wherein the top and bottom boundary layer flows are controlled with circumferential grooves.

10. A technique for achieving calculated $NO_x$ reductions from EGR in heterogeneous combustion systems comprising a burner where fuel and oxidizer are heterogeneously mixed and burned and wherein the products of such burning are cooled to produce useful energy and said products of combustion, called exhaust gas are available in a duct at relatively moderate temperatures, ducting means whereby a fraction of said exhaust gas is recycled into the intake air supplying said burner and whereby the mixing of air and EGR is accomplished with a vortex mixer wherein a relatively large number of alternating "stripes" of air and EGR are introduced into the entrance upstream of the vortex so that the high shear structured turbulent mixing process of the vortex acts to produce microscale homogeneity for very large scale mixer sections.

where this homogeneous air EGR mixture is called oxidizer, and where this oxidizer is fed as the total oxidizer supply to the heterogeneous burner, whereby the peak flame temperatures in the heterogeneous combustion process are lowered for all microvolumes in the burner and so that the rates of NO formation in all of these microvolumes are small so that the total $NO_x$ output of the burner is suppressed to a level approximating the NO output which would be predicted calculating combustion with homogeneous microscale mixing of air and EGR and a statistical distribution of fuel oxidizer ratios.

* * * * *